United States Patent [19]

Greenway

[11] Patent Number: 4,595,078

[45] Date of Patent: Jun. 17, 1986

[54] FALL ARREST DEVICE FOR POLE CLIMBERS

[76] Inventor: William E. Greenway, c/o General Delivery, Millgrove, Ontario, Canada, L0R 1V0

[21] Appl. No.: 703,851

[22] Filed: Feb. 21, 1985

Related U.S. Application Data

[63] Continuation-in-part of Ser. No. 669,141, Nov. 7, 1984, which is a continuation-in-part of Ser. No. 611,239, May 17, 1984, abandoned.

[51] Int. Cl.[4] ..... A62B 35/00

[52] U.S. Cl. ..... 182/9; 182/133

[58] Field of Search ..... 182/9, 93, 133, 134, 182/135, 206, 221

[56] References Cited

U.S. PATENT DOCUMENTS

| | | | |
|---|---|---|---|
| 213,715 | 3/1879 | Von Mengden | 182/134 |
| 869,382 | 10/1907 | Newton | 182/9 |
| 1,036,987 | 8/1912 | Feinen | 182/9 |
| 1,955,473 | 6/1933 | Raymer | 182/9 |
| 2,842,300 | 7/1958 | Johnson | 182/133 |
| 2,879,830 | 3/1959 | Johnson | 182/9 |
| 2,920,714 | 1/1960 | Johnson | 182/9 |
| 3,856,111 | 12/1974 | Baker | 182/135 |
| 4,130,177 | 12/1978 | Pandolph | 182/133 |
| 4,137,995 | 2/1979 | Fonte | 182/135 |
| 4,168,765 | 9/1979 | Ferguson et al. | 182/187 |
| 4,407,391 | 10/1983 | Greenway | 182/9 |

*Primary Examiner*—Reinaldo P. Machado

*Attorney, Agent, or Firm*—Hirons, Rogers & Scott

[57] ABSTRACT

A fall arrest device for a pole climber which has a main yoke with resiliently biased arms at each end for partly encompassing a pole. The resiliently biased arms are movable in the same plane as the main yoke and also urge the secondary yokes into contact with the pole to accommodate a range of pole diameters. Handles are attached to each arm for gripping by the pole climber to move the arms so that the fall arrest device can be raised or lowered, and each arm also has eyelets for receiving safety straps attached to the pole climber. In a preferred embodiment the arms have sharp projections for biting into the pole. A pull on the strap, due to slippage of the pole climber, causes the arms to move towards each other and the sharp projections to bite tightly into the pole. Alternative embodiments are also described.

20 Claims, 17 Drawing Figures

FALL ARREST DEVICE FOR POLE CLIMBERS

This is a continuation-in-part patent application of patent application Ser. No. 669,141 filed Nov. 7, 1984 which is a continuation-in-part of patent application Ser. No. 611,239 filed May 17, 1984 now abandoned.

The present invention relates to a fall arrest device for pole climbers and particularly, but not exclusively, for use by linemen and the like who have to climb poles in the course of their duties.

A pole climber normally wears lineman's gaffs strapped to each leg, which are designed to engage the pole when climbing to prevent slipping and provide purchase for his feet. The pole climber uses a pole climber's device in conjunction with the gaffs, which usually takes the form of a strap which can be looped around the pole and attached to the waist belt of the lineman. The strap is principally used for supporting the lineman as he works but can also be used to assist climbing the pole. In the latter case the strap is thrown up, and tensioned to support the lineman who then climbs up the pole using his gaffs.

If the lineman's gaffs slip or become disengaged from the pole, the strap would not normally prevent the climber from falling down the pole and serious injuries can result from such accidents.

There are many design criteria to be satisfied in designing a pole fall arrest device apart from the obvious requirements of lightness, simplicity and, of course, electrical insulation. To prevent the climber from falling down the pole, a pole climber's fall arrest device should support the full weight of the climber; it should engage the pole by itself without needing the weight of the lineman and it should support the climber in any working position. Also, the device should be easily movable to different heights and diameters on the pole without interfering with cables or cable sheathing running lengthwise on the pole, and further, during movement between heights the device should rapidly and effectively engage the pole in the event of the lineman slipping during such movement. If the lineman does slip the device should automatically close on the pole due to the weight of the lineman independently of any corrective measures taken by the lineman.

A number of such fall arrest devices for pole climbers have been proposed. For example, U.S. Pat. No. 213,715 to Mengden discloses pole climbing apparatus which required two frames; one for use by the hand and the other by the feet. The hand-operated frame encompasses the pole and is adjustable to accommodate poles of different diameters by means of pins which can be passed through registering openings in pairs of frame members at the front and at rear of the apparatus. This device has a number of significant disadvantages. Firstly, it is complex to adjust because both the front and rear frames require adjustment. Also the pole engaging members are not resiliently biased into contact with the pole and some slippage could occur unless the weight of the lineman always acts on the members.

U.S. Pat. No. 869,382 to Newton, discloses a lineman's fall arrest device which has an adjustable belt looped around the lineman and the pole. The belt includes a curved plate with spurs for engaging the pole and an arm for moving the spurs between a pole engaging and a pole non-engaging position. In the event of slipping, the spurs are insufficient to retard the fall of the lineman. Climbing the pole is awkward with such a device.

U.S. Pat. No. 1,036,987 to Feinen relates to a fire escape and a travelling member for use therewith. The fire escape is formed by a series of rounded projections extending from the ground upwardly and the travelling member has a C-shaped frame, hinged in the middle of the "C-shape". Spring biased blades are provided which engage the projections and which deform due to the weight of a person hanging onto handles so that when a person hangs onto the travelling member it moves over the rounded projections. This member is not a pole safety device, nor could it be used as a pole climber's fall arrest device because as it is intended to slip down a pole in response to the weight of a person. It would therefore not support his weight. Also this device is not adjustable because once locked in position, it is held locked by a spring until it reaches the ground.

U.S. Pat. Nos. 2,842,300 to Johnson; 2,879,830 to Rayner and 2,920,714 to Johnson all disclose pole climbing aids which encircle the pole and which have teeth for engaging the pole. None of these devices is resiliently biased and adjustability is difficult in situ. In the event of slippage these devices may be insufficient to retard the lineman's fall because they do not automatically close on the pole.

U.S. Pat. No. 4,407,391 to Greenway, et al discloses a pole climber's safety device having a closed yoke for encompassing a pole. The yoke consists of two half yokes hingedly interconnected together and secured by a releasable fastening. Pole engaging blades are pivotally mounted on the underside of the yoke and, in use, the blades are normally biased, by weight or by springs, to a pole engaging position and are manually releasable. In practice, it has been found that this device is difficult and time-consuming to adjust, because first the pole blades have to be retained and held whilst the yoke is moved. The fixed closed yoke limits the size of poles it can be used with. Indeed with some poles the lineman could not climb to the top because the blades do not engage adequately the upper parts of the pole and on larger poles the blades do not engage the pole because they lie almost parallel to the pole. Also, the closed yoke can interfere with cables and/or cable sheathings especially larger ones, and may cause restriction in movement of the device. This device has been found unsatisfactory in breaking the fall of a lineman whose feet have slipped and the lineman can fall quite a way before his fall is broken, if at all.

An object of the present invention is to provide an improved pole climber's fall arrest device and to obviate or mitigate the disadvantages associated with the above-mentioned safety devices.

In accordance with one aspect of the present invention a pole climber's fall arrest device is provided which comprises, an arcuate yoke member for engaging a pole, and resiliently biased arms pivotally mounted at opposite ends of the arcuate member for further engaging the pole. Each arm is pivotable in planes parallel to the arcuate yoke member and has attachment means for coupling the device via a lanyard to safety belt connectors and handle means on each arm adapted to be gripped by a pole climber. The yoke member and the arm each have a surface for engaging the pole and, in use, the resiliently biased arms retain these surfaces in contact with the pole. The arms are movable by the pole climber relative to the yoke member, away from the pole against said resiliently biased means to permit movement of the fall arrest device lengthwise of the pole.

In a preferred embodiment of the invention, the arms include a sharp projection for biting into the pole. Coil springs connected between each arm and the yoke provide the biasing force. The yoke is made using tubular metal and castings and the arms are castings. The device includes stop means for preventing the arms from being rotated too far about its pivotal axis. The yoke is tubular and by also making parts of the arms tubular the design of the preferred embodiment can be made different sizes. The handles also serve as means for securing a lanyard to the device which, in turn, is secured to the linemans safety belt connectors.

In an alternative embodiment of the invention, the arms have pivotable jaws mounted thereon, each jaw having two surfaces for engaging a pole. The surfaces are at different distances from the pivotal axis of the jaw so that, by rotating the jaws about the jaw axis, any one of the two surfaces can be brought into a pole-engaging position. This permits the device to accommodate a large range of pole diameters.

In a further embodiment of the invention the arcuate yoke is hinged midway between the ends to allow the device to be folded when not in use. Each arm is also connected to the yoke member by smaller secondary yoke elements, one end of which can be slid relative to the yoke member and the other end which is pivotable relative to the arm in the same plane as the yoke member. The smaller secondary yoke elements also have a pole engaging surface. The pole engaging surfaces are preferably serrated to facilitate gripping of the pole by the device.

These and other aspects of the invention will be readily understood with reference to the following description and drawings in which.

Figure 14:
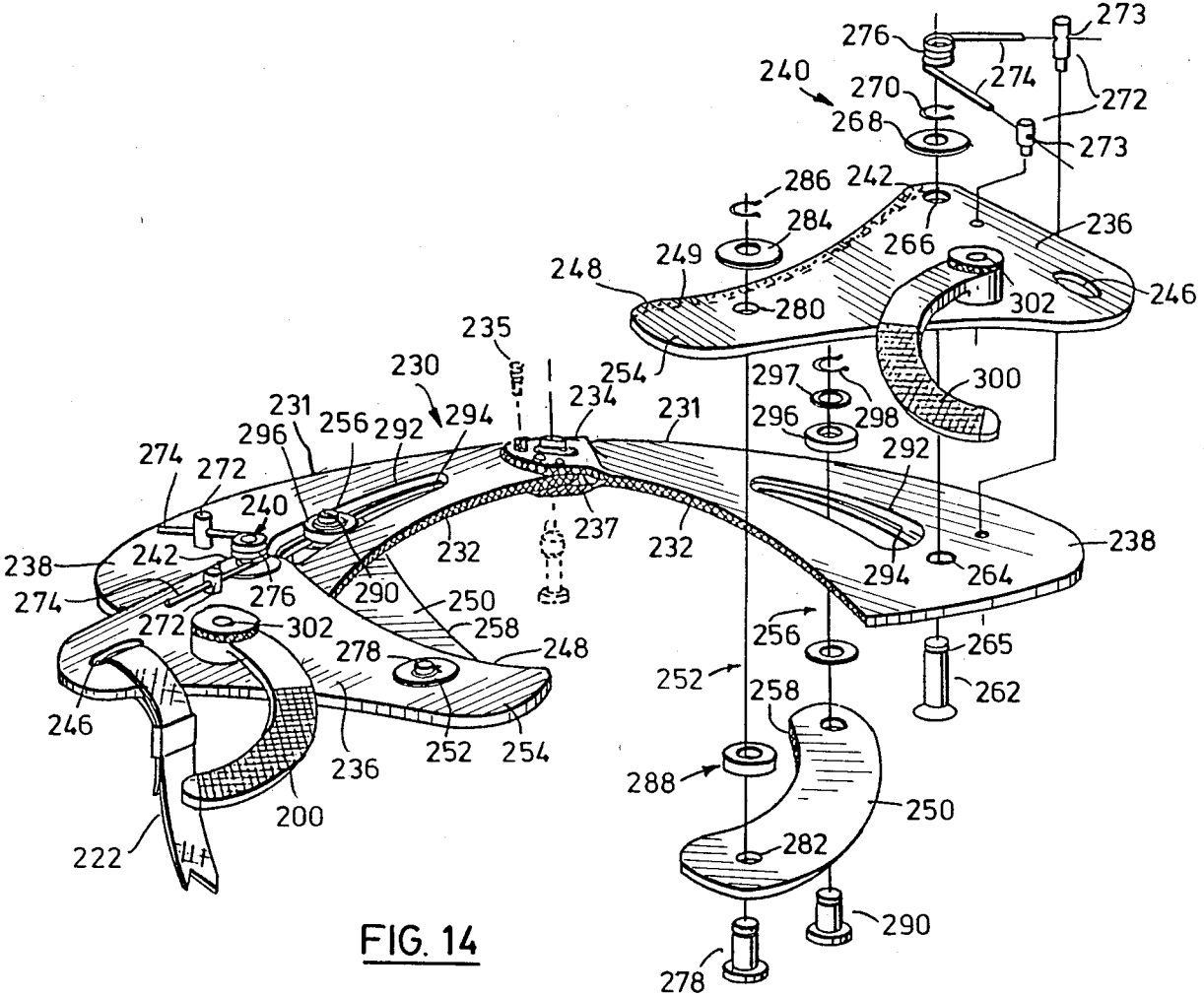
FIG. 14 is a partly exploded perspective view of a pole climber's fall arrest device, shown in FIGS. 12 and 13, drawn to a larger scale.
Figure 17:
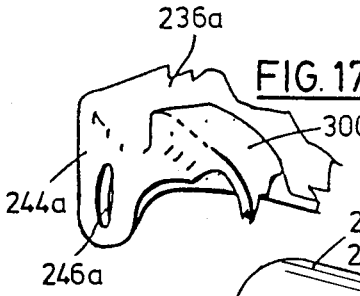
Figure 16:
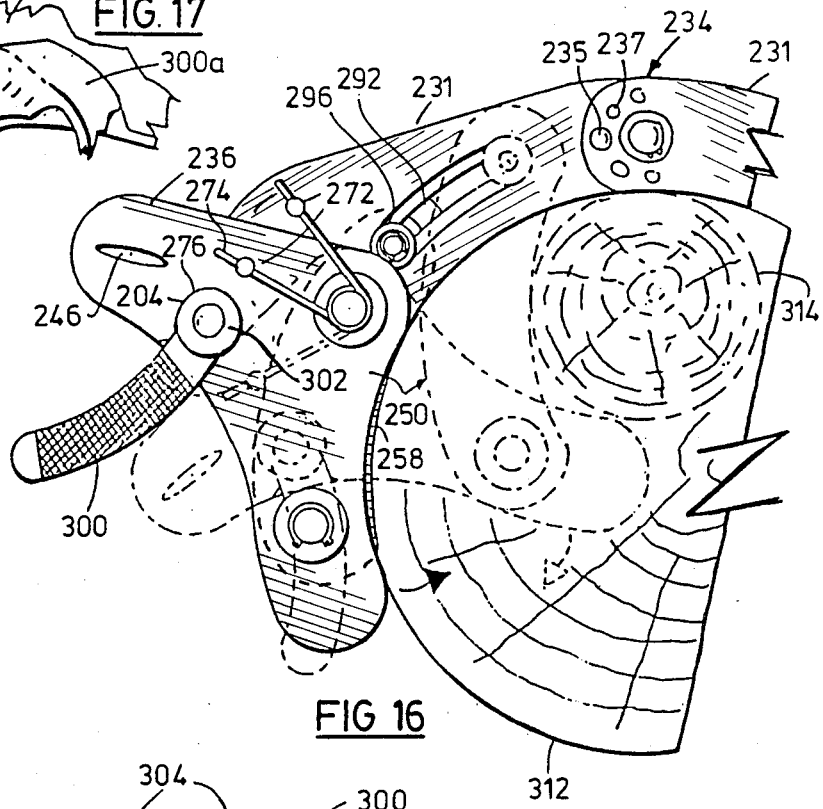

FIG. 16 is a bird's eye view to the same scale as FIG. 14 of part of a pole climber's fall arrest device according to the alternative embodiment of the invention and showing the position of an arm relative to the yoke for two different pole diameters; and FIG. 17 is a view to the same scale as FIG. 14 of part of an arm showing a part of an alternative arm structure for attachment to a safety belt strap.

Figure 1:
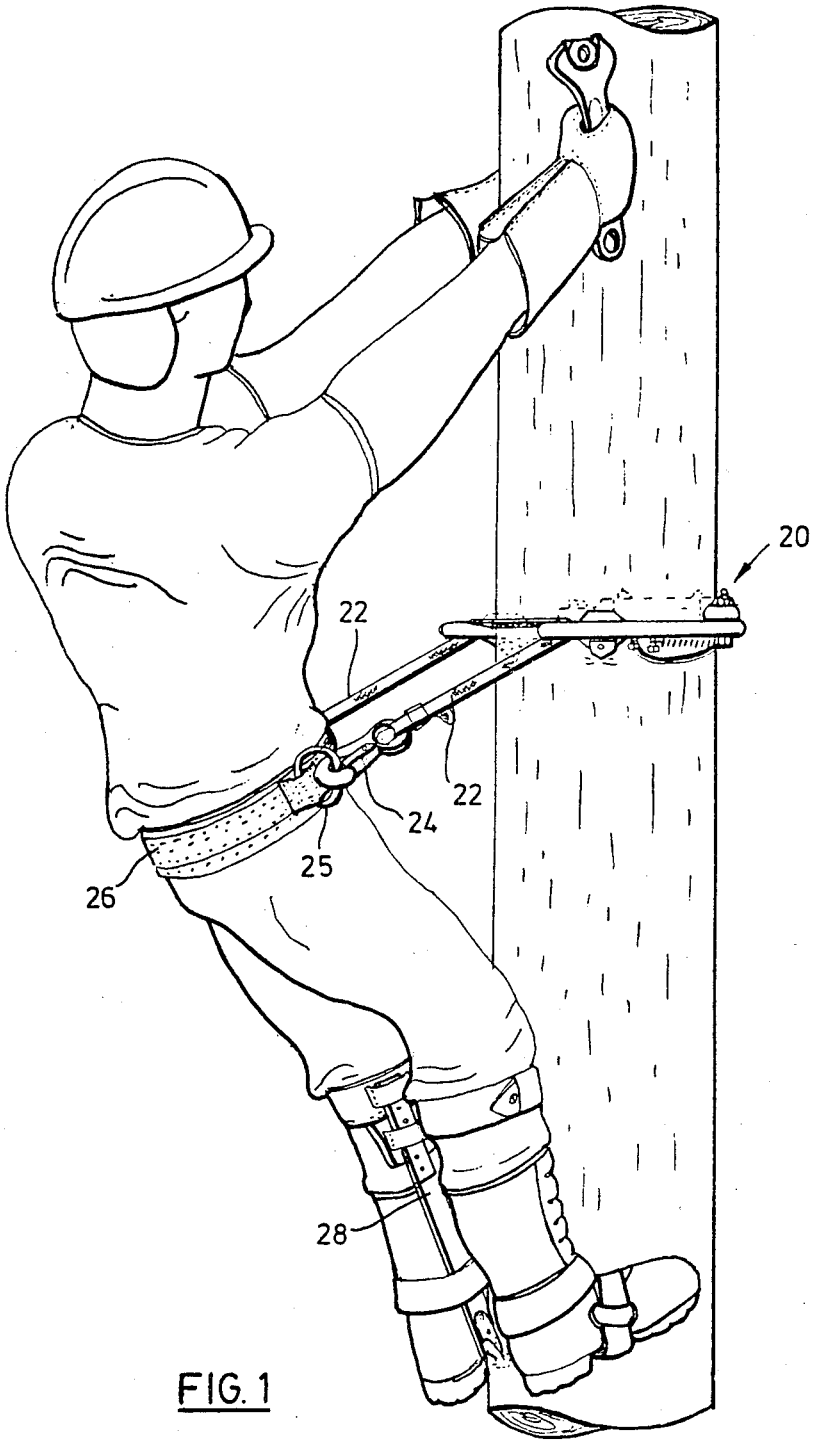
FIG. 1 is a diagrammatic view of a lineman using a preferred form of pole climber's fall arrest device in accordance with the invention.

Reference is first made to FIG. 1 of the drawings which shows a lineman working on a telephone pole using a fall arrest device 20 in accordance with the preferred embodiment of the invention and which is secured to the pole and to which he is connected by a safety strap 22 looped through the device. The safety strap 22 has respective hooks 24 at its outer ends, (one of which is shown) and which engage with D-rings 25 attached to the lineman's belt 26. The fall arrest device 20 is secured around the telephone pole, and as will be later explained, the lineman is supported by a combination of a pair of gaffs 28, (one of which is shown) and by the device which is biased to engage the pole. In the working position, a component of the lineman's weight acts on strap 22 to produce a force on the fall arrest device which acts, in combination with a spring force on arms 24, to pull the arms of the device towards the pole to increase engagement of the device on the pole as will be later explained.

Figure 2:
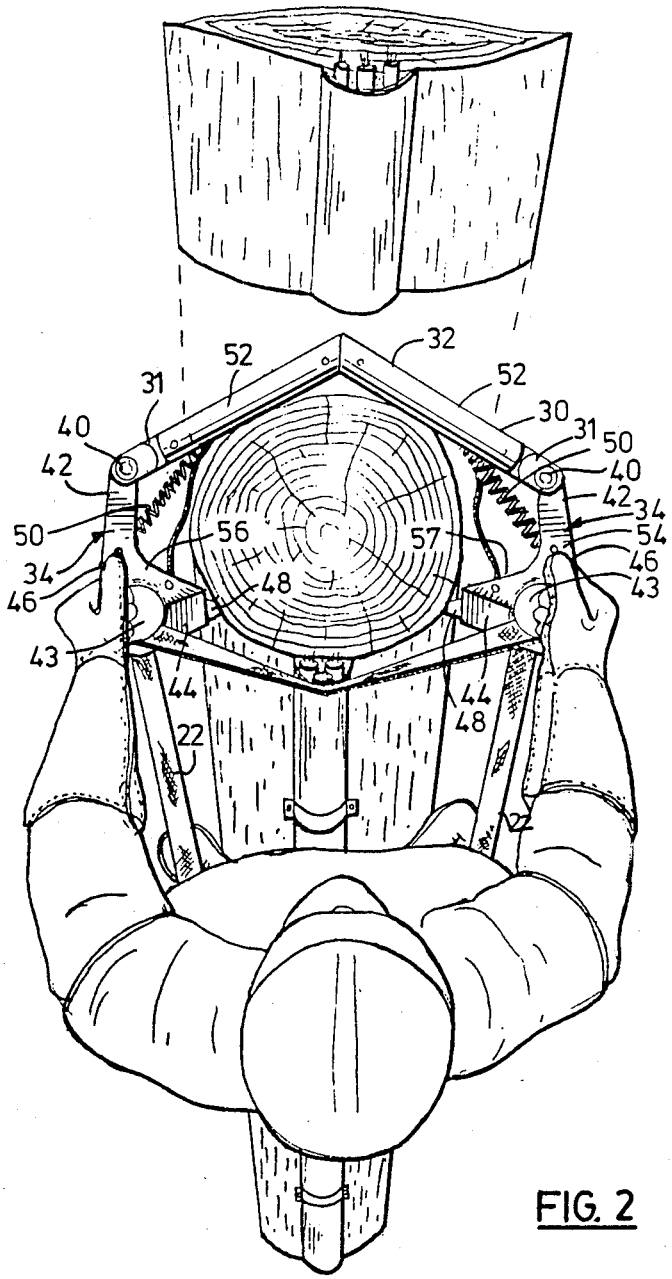
FIG. 2 is a bird's eye view of the device in FIG. 1 in use with part of the pole broken away to show the device.
Figure 3:
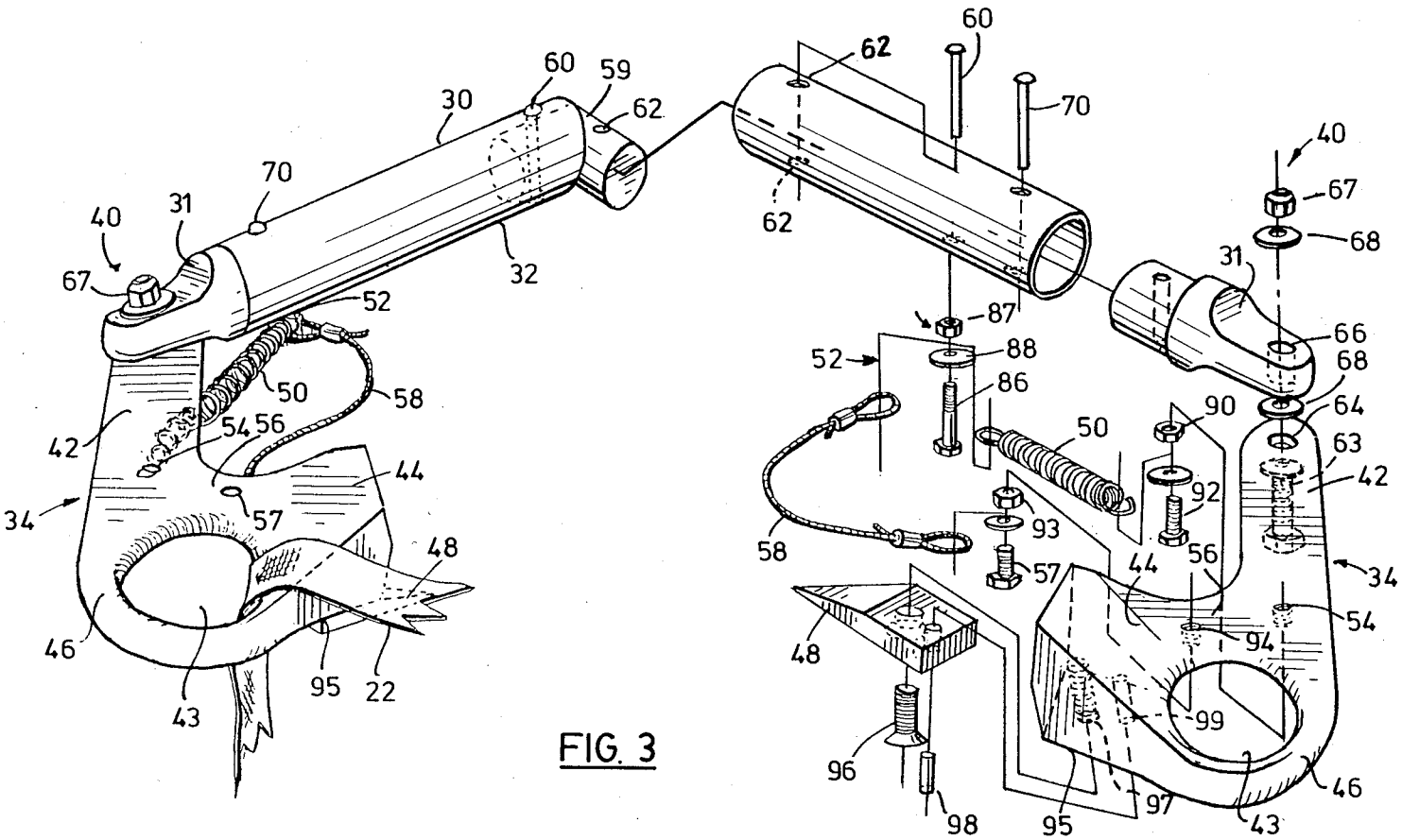
FIG. 3 is a partly exploded and perspective view of a pole climber's fall arrest device shown in FIGS. 1 and 2 and drawn to a larger scale.

To better illustrate how the safety device is mounted on the pole, reference is now made to FIGS. 2 and 3 of the drawings. In FIG. 2 the pole is shown partly broken away to facilitate understanding. The fall arrest device comprises a generally V-shaped main yoke 30 which is tubular and lies in a plane. The tubing is 6061 T6 aircraft grade aluminum (Atlas Alloys, Toronto, Ontario) and which is covered with a nylon insulating dielectric material Rilsan 11 (Trade mark, Rilsan, U.K.). The yoke 30 has an inner surface 32 for engaging parts of the far sides of the pole from the lineman. Tenzaloy (trademark Federated Genco, Burlington, Ontario, Canada) castings 31 and 59 (FIG. 3) are bonded by expoxy resin and riveted to the ends of the yoke and the castings, as best seen in FIG. 3 are coupled to arms 34.

Planar arms 34, which for convenience of description will be described as being generally L-shaped, are coupled to each casting 31 by pivotal connections 40. The arms are allochiral and, for convenience of description, one arm will be described although the other arm will be numbered for ease of comparison. The arm will also be described as having legs because it is generally L-shaped. A first longer leg 46 of the arm is connected to the casting 31. In a second shorter leg 44 the arm has a large generally circular aperture 43 for receiving a lanyard or strap 22 to permit the fall arrest device to be fastened to the belt as described above. The portion 46 of the arm between the aperture and the edge permits the arm to be grasped and constitutes handle means. It will be seen that the straps loop through the apertures of each arm and thus provide means for attaching the lanyard to the fall arrest device to be attached on opposite sides of the lineman's belt. The reason for this is that the forces generated during a fall cause the arm to pivot about pivotal connection 40 and generate substantial force against the pole. The second leg 44 is thicker than the first leg 42 and has sharp stainless (#304) steel projections 48 fastened to the bottom thereof. The sharp projections 48 facilitating the arms biting into the pole for better penetration and grip.

The arms 34 are biased into engagement with the pole by steel coil springs (58 lbs force) 50 which are connected between a spring anchor position 52, located on the yoke inboard of the pivotal connection 40 and a spring anchor position 54 on leg 42 and spaced from pivotal connection 40. The relative location of these anchor positions is important because it varies the location of the spring with respect to the pole surface and hence the spring force. For example, if the anchor 54 is moved towards the aperture 43 spring-biased moment acting about pivotal connection 40 would increase the force of the arms acting on the pole surface. However, the further the anchor pins are moved towards the aperture 43 the smaller the diameter of pole which can be accommodated by the pole climbers fall arrest device. It has been found in practice that by locating the anchor pins as shown, the fall arrest device according to this embodiment will accommodate pole diameters up to about 21 inches, i.e., is about 75% of the pole diameters used.

Between the anchor 52 and an anchor pin 57 or portion 56 of leg 44 a stop wire 58 is connected which extends beneath the arms as best seen in FIG. 3. This wire acts as a stop to prevent the arm 34 from being rotated too far about the pivotal connection 40 so that the springs do not go over centre as will be explained. The construction of pivotal connections 40 will also be later explained.

Reference is now made to FIG. 3 of the drawings which shows a pole climber's fall arrest device according to the preferred embodiment in an enlarged and partly exploded view. It will be seen that the yoke 30 consists of two tubes which are connected together by an elbow casting 59 to provide, when assembled, the V-Shape. The casting and tubular portions are joined by epoxy resin and are also riveted together with steel rivets 60 through pre-drilled apertures 62 in the castings and tubes. Similarily castings 31 are riveted by steel rivets 70 to the other ends of the tubes through pre-drilled apertures, as well as being bonded with expoxy resin to provide a very strong secure connection. It will also be seen that pivotal connection 40 is provided by a grade 8 bolt 63 which passes through aperture 64 in the end leg and aperture 66 in the casting 31 for engagement with a self locking Nylok (trademark) nut 67. Washers 68 are provided on the top and bottom parts of the casting to permit freely pivotal movement of the arm.

The spring 50 and stop wire 58 are fastened to the yoke 30 by bolt 86 and nut 87 to provide the anchor 52. A washer 88 is provided to retain wire 58 and spring 50. The other end of the spring 50 is anchored at position 54 by a nut 90 and bolt 92. The other end of the stop wire 58 is fastened by bolt 57 and nut 93 to the portion 56 via aperture 94. Aperture 54 is located inboard of aperture 94 so that when the handles of the arms are opened, they are prevented from being opened to an over-centered position of the arm-yoke pivot point by the stop wire 58.

The leg portion 44 has a lower downwardly sloping surface 95 to which the stainless steel projections 48 is connected by a countersunk screw 96 threaded in aperture 97 of the arm. The projection is prevented from rotating by a stainless steel dowel pin 98 which passes through an aperture in the projection to engage with a mating aperture 99 in the arm. The sloping of the lower surface includes the projections 48 to the plane of the device and facilitates penetration of the pole.

The overall thickness of the fall arrest device is a combination of the thickness of the arms and also the depth of the springs. In practice it is about 3 inches.

Figure 5:
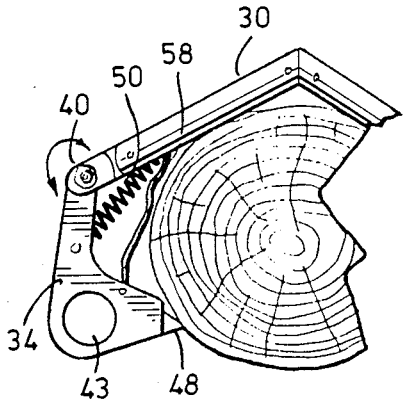
FIG. 5 is a similar view to FIG. 4 to the same scale and showing the orientation of the jaw when the pole diameter is smaller.
Figure 4:
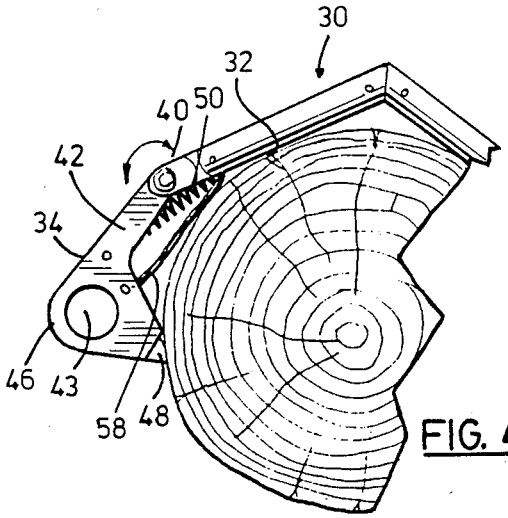
FIG. 4 is a bird's eye view to the same scale as FIG. 3 of part of a pole climber's fall arrest device and showing the position of an arm and jaw relative to the yoke for a large pole diameter.

When the device is assembled as shown in FIGS. 2, 4 and 5 the periphery of the arm permits the sides to be used as handles by the lineman, and the pivotal connections 40 permit the handles to be folded towards each other to occupy less space during transit or storage.

The device when assembled and positioned on the pole, as shown in FIG. 2, appears generally C-shaped in plan. Because the projections do not meet they define an opening 88 which provides clearance for the cables when the fall arrest device is adjusted to pass over the telephone pole. This clearance is convenient because it means that the fall arrest device does not interfere with cables, or the cable safety sheath for the cables which run between the base and the top of the pole.

The operation of the fall arrest device will now be described with reference to FIGS. 2, 4 and 5 of the drawings. In FIG. 4 one half of the fall arrest device is shown mounted (in solid lines) on the pole, at a larger diameter and FIG. 5 shows the same fall arrest device when moved up the pole to accommodate a pole of smaller diameter.

In use, the lineman grips the handles or arms 34 and opens them sufficiently so that the pole fall arrest device can be located around the base of the pole. The lineman then pulls the handles away from each other and the spring force produced by spring 50 then forces the projections 48 into contact with the pole, and also causes the inner surface 32 of the yoke to engage with the rear surface of the pole. The stop wire 58 tensions and prevents the arms being rotated too far. The lineman then connects the device to the D-rings on his belt as previously described.

To climb the pole, the lineman firstly relieves his weight on the device by using his gaffs 28 to support his weight and then he grips the handles provided by the arm 34 and pulls the arms apart sufficiently to separate the projections 48 from the pole and the yoke surface 32 and then lifts the device to a higher position and releases the arms. Spring forces urge the arms with projections back into contact with the pole and the lineman then, using the device as a support, climbs the pole using his gaffs.

The lineman continues to climb in this way until he reaches his desired working position at a level where the pole is of a different diameter such as shown in FIG. 5. In this position, the pole fall arrest device is secure and the lineman can lean back as shown in FIG. 1 to be supported by the strap 22 and gaffs 28. In the event that his feet should slip because the gaffs are not properly engaged and he begins to fall, the strap 22, is pulled loading the arms 34 and pulling them inwardly towards the pole to reinforce the spring force acting on the arms 34 and causing the sharp projections 48 to bite tightly into the pole. Because of the spring forces and the weight of the lineman the device grips the pole so tightly that the device, and hence the lineman, are prevented from slipping down the pole, and the lineman's fall is arrested. The shape of the sharp projections and their orientation on the yoke in combination with the fact that the device is weight activated, cause the device to close automatically in the event of slippage such that the projections will bite into oily, icy, soft, or hard poles. This means that if slippage of the lineman should occur at any level, the fall arrest device would be effective.

Figure 6:
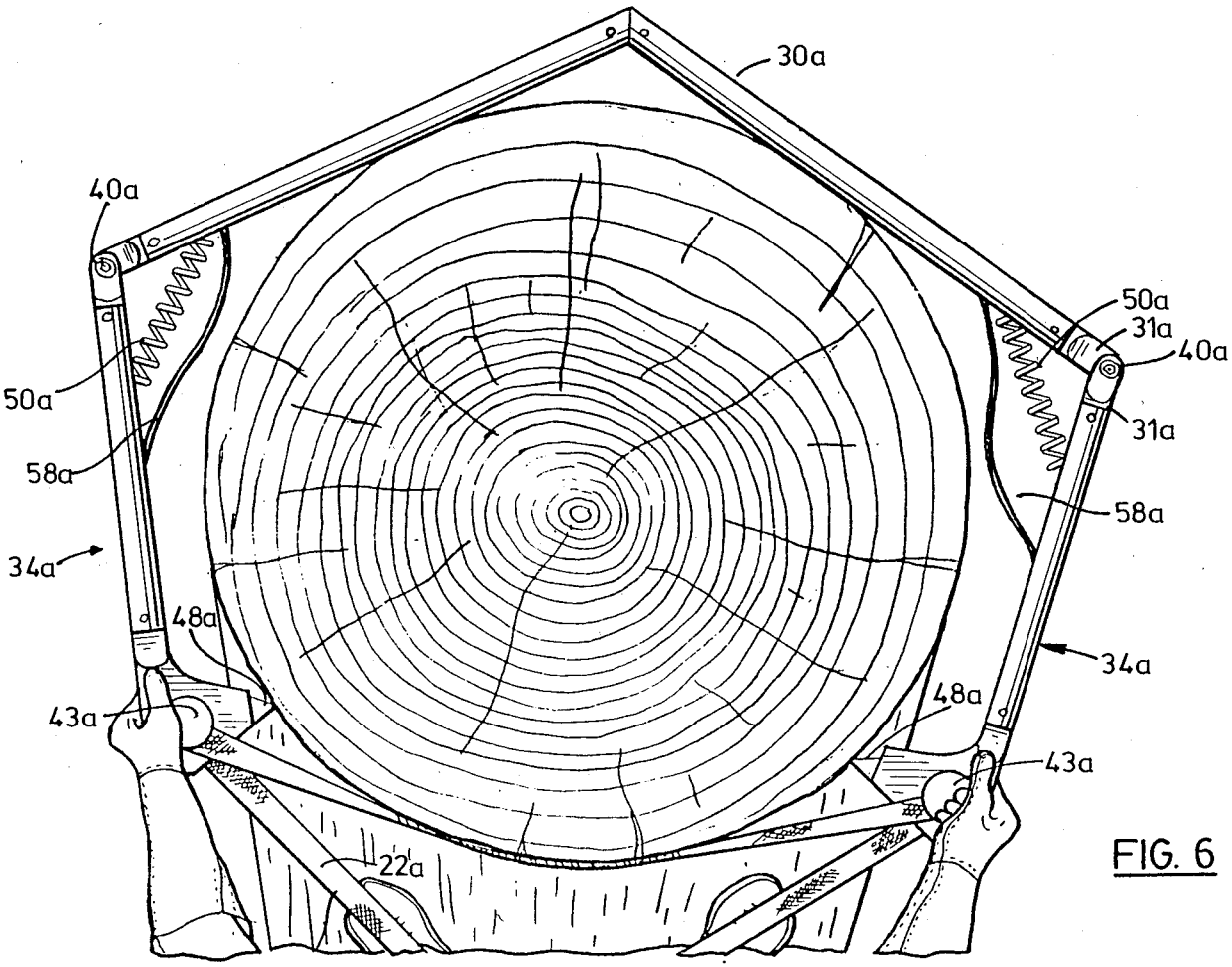
FIG. 6 is view of a device shown in FIG. 1 and modified for use on larger diameter poles.

Various modifications may be made to the embodiment hereinbefore described without departing from the scope of the invention. For example, FIG. 6 shows a modified device according to the preferred embodiment for use in climbing very large diameter poles, in which like numerals refer to like parts as FIGS. 1–5 but with the suffix "a". It will be seen that this is very similar to the device of FIGS. 1–5 except that yoke 30*a* is made of longer tubular portions. Also the arms have tubular leg portions inserted between arm casting 34*a* and a casting 31*a* coupled to pivotal connector 40*a*. It will be appreciated that this use of tubular portions permits the preferred device to be made of a size suitable for different ranges of pole diameters. The device in FIG. 6 can be used with poles up to 60 inches in diameter, which covers almost all poles in use.

It will also be appreciated that all relevant parts of the device i.e., yoke, arms, projections etc. will be covered with the Reslin dielectric coating. Although only a single yoke is shown, it will be appreciated that two half yokes could be provided being hinged together about the center so that the device could either fold about an axis parallel to the pivotal axis 40 or about an axis perpendicular to the pivotal axis 40 to permit folding for storage and transport. In such a case it will be appreciated that stops would be required to be located in the surfaces of the yoke opposite to the direction of folding, and locking pins would be required to secure the yoke in its in-use position. It will be appreciated that although coil springs are shown connecting the arms to the yoke, any other resilient connection would be suitable. For example, an elastomer having a very strong resilient force could be used or torsion springs could be used.

Figure 7:
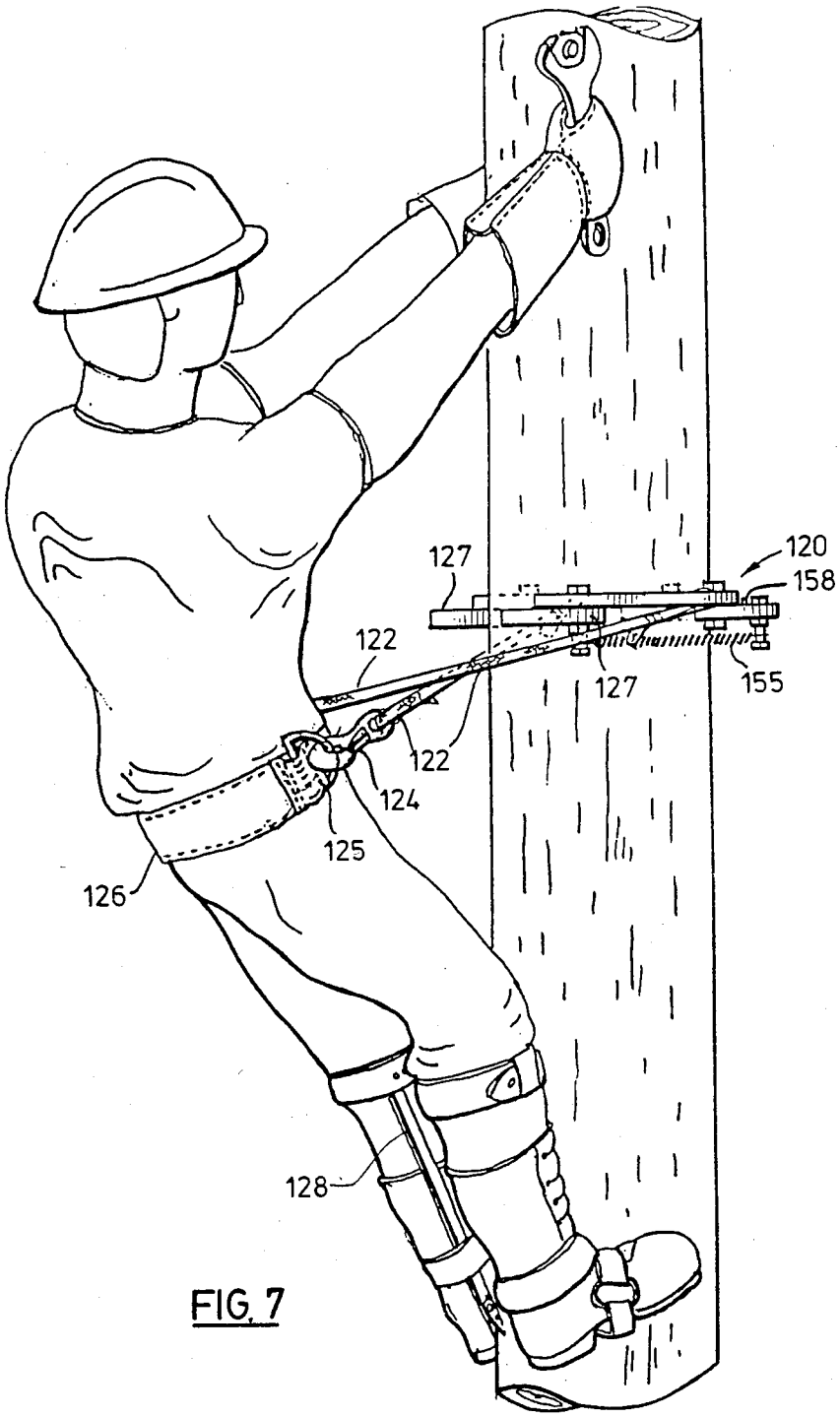
FIG. 7 is a diagrammatic view of a lineman using an alternative form of pole climber's fall arrest device in accordance with the invention.

Reference is now made to FIG. 7 of the drawings which shows a lineman working on a telephone pole using a fall arrest device 120 in accordance with an alternative embodiment of the invention and which is secured to the pole and to which he is connected by a safety crossed straps 122 hooked through the device. The safety strap 122 has respective hooks 124 at their outer ends, (one of which is shown) and which engage with D-rings 125 attached to the lineman's belt 126. The fall arrest device 120 is secured around the telephone pole, and as will be later explained, the lineman is supported by a combination of a pair of gaffs 128, (one of which is shown) and by the device which is biased to engage the pole. In the working position, a component of the lineman's weight acts on strap 122 to produce a force on the fall arrest device which acts, in combination with a spring force on jaws 127, to pull the arms and jaws of the safety device towards the pole to increase engagement of the device on the pole as will be later explained.

Figure 8:
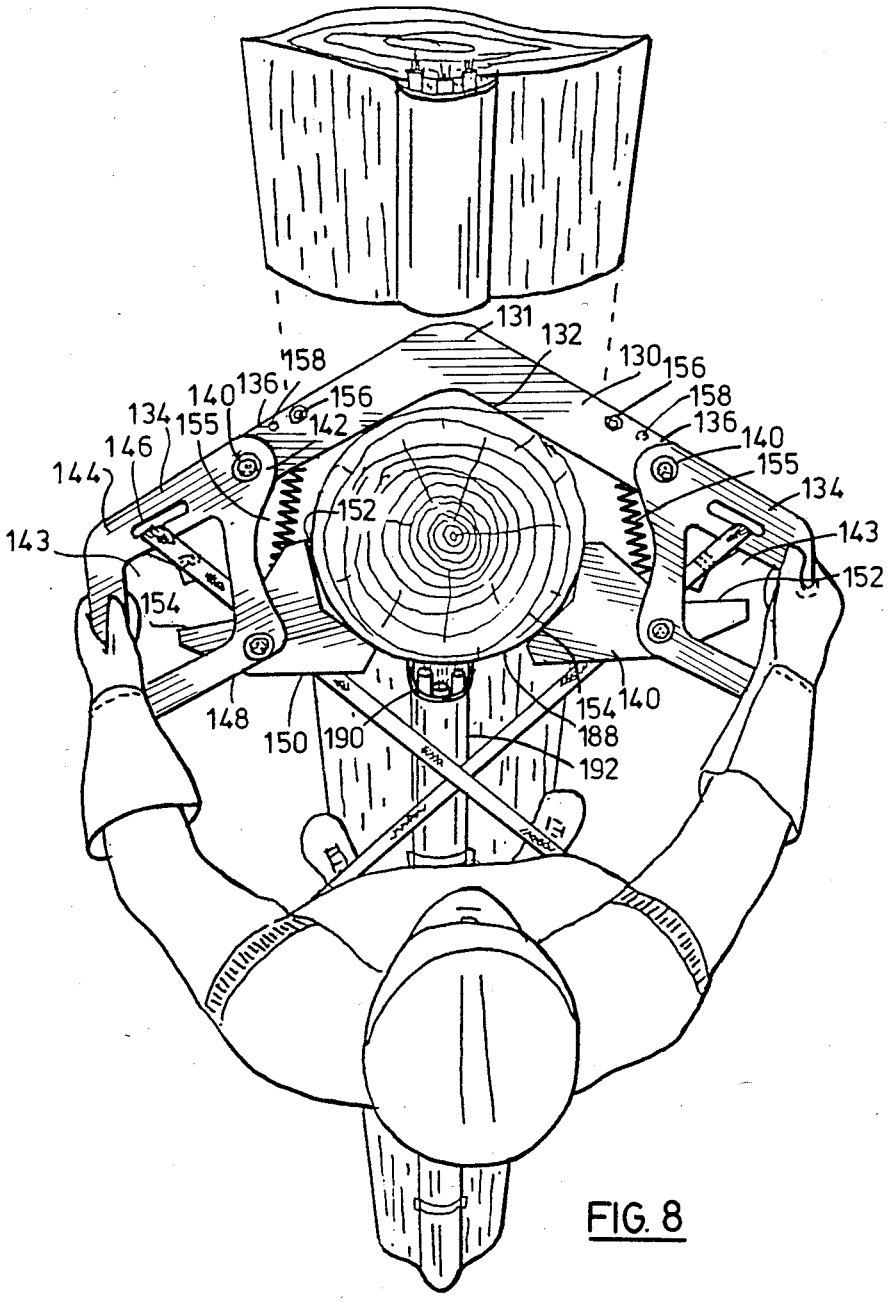
FIG. 8 is a bird's eye view of the device in FIG. 7 in use with part of the pole broken away to show the device.
Figure 9:
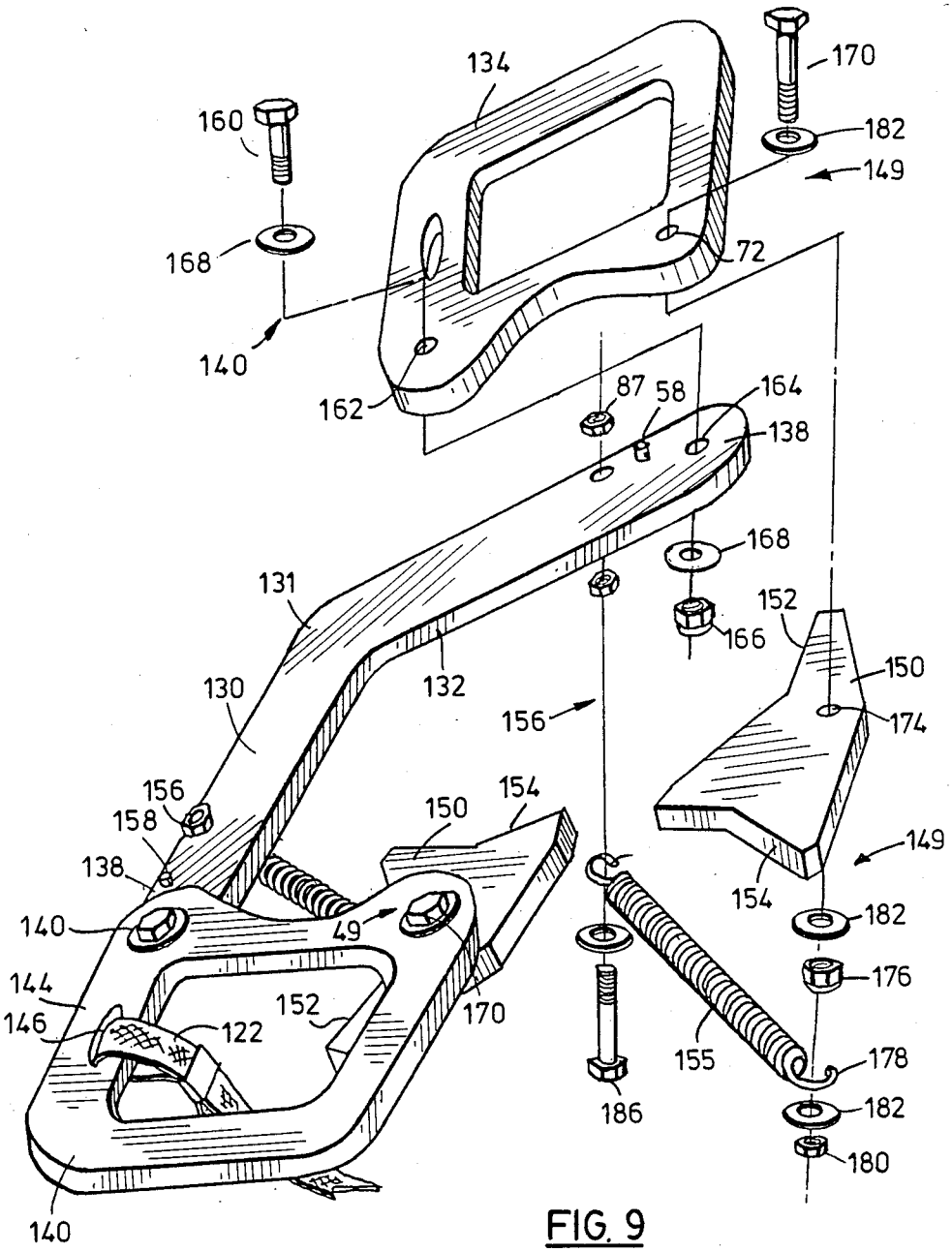
FIG. 9 is a partly exploded and perspective view of a pole climber's fall arrest device shown in FIGS. 7 and 8 and drawn to a larger scale.

To better illustrate how the safety device is mounted on the pole, reference is now made to FIGS. 8 and 9 of the drawings. In FIG. 8 the pole is shown partly broken away to facilitate understanding. The fall arrest device comprises a generally V-shaped main yoke 130 which is essentially planar and which is made of a cast alluminum alloy, (Tenzaloy), and which is covered with an epoxy resin insulating dielectric material. The yoke 130 has an inner surface 132 for engaging parts of the far sides of the pole from the lineman.

Two planar arms 134, which for convenience of description will be described as being generally diamond shaped, are mounted on the upper surface of each outer end 138 of the yoke 30 by pivotal connections 140. The arms are allochiral and, for convenience of description, one arm will be described although the other arm will be numbered for ease of comparison. The arm will also be described as having apices because it is generally diamond shaped. A first apex 142 of the arm is connected to the outer end 138 of the yoke. The arm has a large generally diamond-shaped aperture 143 for reasons of lightness and has in one section 144 an elongate slot 146 for receiving straps 122 to permit the fall arrest device to be fastened to the belt as described above.

It will be seen that the straps cross over to be attached on opposite sides of the lineman's belt. The reason for this is that the forces generate during a fall cause the arm to pivot about pivotal connection 140 and generate substantial force against the pole. A second apex of the arm 148 has a pivotal connection 149 to a jaw 150. The jaw 150 has two generally V-shaped surfaces 152, 154 at different distances from the pivot point and which can be rotated as desired into engagement with the pole surface. The pole engaging surface 152 of the jaw 150 is at a further distance from the pivotal connection 149 and the jaws are generally pivoted to this position when the pole diameter is larger. When the pole diameter is smaller, for instance when the lineman starts to climb the pole, then the jaws 150 are rotated about the pivotal connection 149 to bring generally V-shaped surfaces 154 in contact with the pole, as shown in FIG. 8 for purposes of illustration only.

The arms 134 and jaws 150 are biased into engagement with the pole by steel coil springs 155 which are connected between the pivotal connections 149 and a spring anchor position 156, located on the yoke inboard of the pivotal connection 140. The location of this anchor is important because it varies the location of the spring with respect to the pole surface. For example, if the anchor is moved towards the apex 131 of the yoke 130 the spring-biased moment acting about pivotal connection 140 would increase the force of the jaws acting on the pole surface. However, the further the anchor pins are moved towards the apex 131 the smaller the diameter of pole which can be accommodated by the pole climbers fall arrest device. It has been found in practice that by locating the anchor pins as shown, the fall arrest device according to this embodiment will accommodate pole diameters up to about 21 inches, i.e., is about 75% of the pole diameters used.

Between the pivotal connection 140 and the anchor 156 is located a stop pin 158 which extends above the surface of the yoke 130 as best seen in FIG. 9. This pin acts as a stop to prevent the arm 134 from being rotated too far about the pivotal connection 140 and limits it to movement as shown in dotted outline in FIG. 11, as will be explained. The construction of pivotal connections 140 and 149 will also be later explained. Reference is now made to FIG. 9 of the drawings which shows a pole climber's fall arrest device according to the preferred embodiment in an enlarged and partly exploded view. It will be seen that pivotal connection 140 is provided by a bolt 160 which passes through aperture 162 in the apex 142 of the arm and aperture 164 in the end 138 of the yoke 130 for engagement beneath the yoke with a self locking nut 166. Washers 168 are provided above the arm and below the yoke to permit freely pivotal movement of the arm.

Pivotal connection 149 is also provided by a bolt 170 which passes through an aperture 172 in a second apex of the arm and through a corresponding aperture 174 in respective jaw 150 for engagement with a self locking nut 176 beneath the jaw. The bolt 170 also receives one end 178 of the spring and the bolt also has another lower nut 180 to sandwich the end of the spring 178 between nuts 176 and 180. Washers 182 are also provided in this pivotal connection to permit free pivotal movement of the jaw relative to the arm and to the pole.

The other end of the spring 155 is anchored to the yoke 130 via bolt 186 and nut 187 to provide a respective anchor 156 for the arm 134. It will be seen from this figure that arm 134 and yoke 131 lie in parallel planes as the jaws 150. The overall thickness of the fall arrest device is a combination of the thickness of the arm and the jaw and also the depth of the springs. In practice is about 2 inches.

Figure 11:
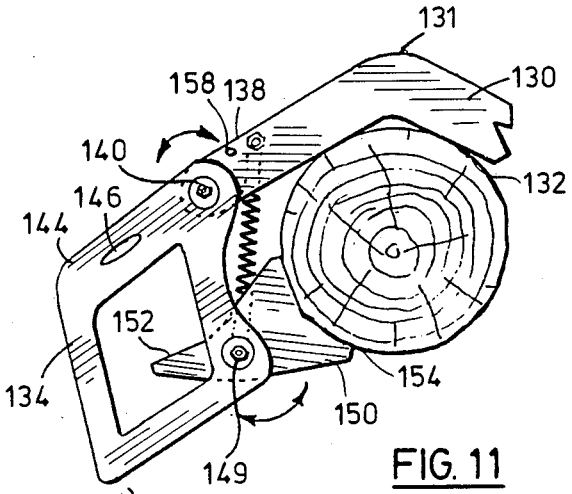
FIG. 11 is a similar view to FIG. 4 to the same scale and showing the orientation of the jaw when the pole diameter is smaller.
Figure 10:
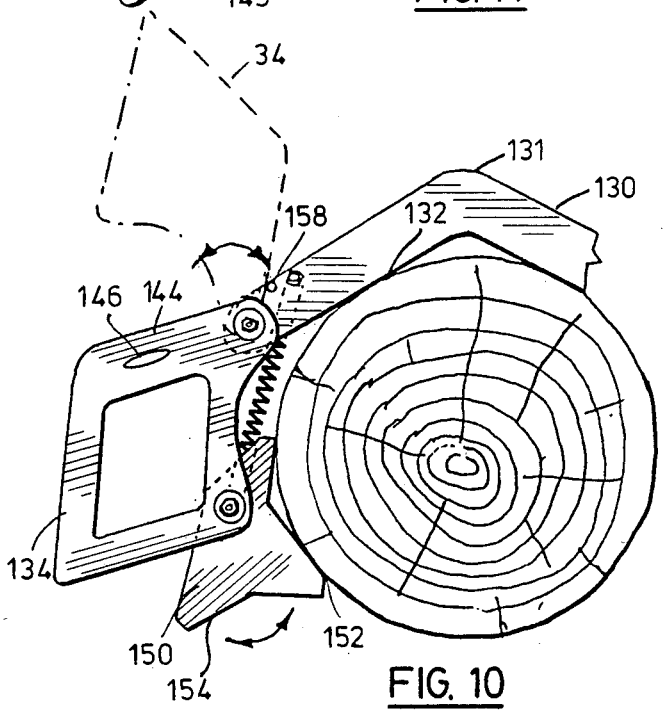
FIG. 10 is a bird's eye view to the same scale as FIG. 9 of part of a pole climber's fall arrest device and showing the position of an arm and jaw relative to the yoke for a large pole diameter.

When the device is assembled as shown in FIGS. 8, 10 and 11 the periphery of the arm permits the sides to be used as handles by the lineman, and the pivotal connections 140 permit the handles to be folded towards each other to occupy less space during transit or storage.

The device when assembled and positioned on the pole, as shown in FIG. 8, appears generally C-shaped in plan. Because the jaws of the arms do not meet they define an opening 188 which provides clearance for the cables but the fall arrest device must be adjusted to pass over the telephone pole. This clearance is convenient because it means that the fall arrest device does not interfere with cables 190, or the cable safety sheath 192 for the cables which run between the base and the top of the pole.

The operation of the fall arrest device will now be described with reference to FIGS. 8, 10 and 11 of the drawings. In FIG. 10 one half of the fall arrest device is shown mounted (in solid lines) on the pole, at a larger diameter and FIG. 11 shows the same fall arrest device when moved up the pole to accommodate a pole of smaller diameter. In the case of FIG. 11 it will be seen that the jaw has been rotated about pivotal axis 149 to present jaw contact surface 154 with the pole instead of surface 152.

In use, the lineman grips the handles 134 and opens them sufficiently so that the pole fall arrest device can be located around the base of the pole. The lineman then pulls the handles towards each other after pivoting the jaws so that the jaw contact surfaces 152 engage the surface of the pole and the spring force produced by spring 155 then forces the arms and pivotal jaws into contact with the pole, and also causes the inner surface 132 of the yoke to engage with the rear surface of the pole. The lineman then connects the device to the D-rings on his belt as previously described.

To climb the pole, the lineman firstly relieves his weight in the device by using his gaffs 128 to support his weight and then he grips the handles provided by the arm 134 and pulls the arms apart sufficiently to separate the pole contacting surface 154 from the pole and the yoke surface 132 and then lifts the device to a higher position and releases the arms. Spring forces urge the arms and the jaws 150 back into contact with the pole and the lineman then, using the device as a support, climbs the pole using his gaffs.

The lineman continues to climb in this way until he reaches his desired working position at a level where the pole is of a different diameter such as shown in FIG. 11. At some level before this the lineman will have pivoted the jaws 50 so that the jaw contact surface 154 abutts the pole and, at the desired level as shown in FIG. 11, the springs urge the arms and the jaws so that surfaces 154 and the yoke surface 132 engage the pole. In this position, the pole fall arrest device is secure and the lineman can lean back as shown in FIG. 7 to be supported by the straps 122 and gaffs 128. In the event that his feet should slip because the gaffs are not properly engaged and he begins to fall, each of the straps 122, are pulled loading the opposite arm 134 and pulling him inwardly towards the pole to reinforce the spring force acting on the jaws 150 and cause the jaw surfaces 154 to bite tightly against the pole. Because of the spring forces and the weight of the lineman the device grips the pole so tightly that the device, and hence the lineman, are prevented from slipping down the pole, and the lineman's fall is arrested. The shape of the jaw contact surfaces 152 and 154 and the yoke contact surface 132 are such that they present a maximum surface contact area to engage the surface of the pole throughout its height. This means that if slippage of the lineman should occur at any level, the fall arrest device would be effective.

Various modifications may be made to the embodiment hereinbefore described without departing from the scope of the invention. For example, although only two jaw contact surfaces are shown, it will be appreciated that more than two could be used depending upon the specific requirements of the pole climber's fall arrest device. In addition, although only a single yoke is shown, it will be appreciated that two half yokes could be provided being hinged together about the centre so that the device could either fold about an axis parallel to the pivotal axis 140 or about an axis perpendicular to the pivotal axis 140 to permit folding for storage and transport. In such a case it will be appreciated that stops would be required to be located in the surfaces of the yoke opposite to the direction of folding, and locking pins would be required to secure the yoke in its in-use position. In addition, it will be appreciated that the eyelets 146 need not be positioned exactly as shown on the arms, for example, they could be located on the section of the arm parallel to the spring, or on the section of the arm nearest to the jaws 150. The eyelet must be outside the pivotal connections 140 so that the straps 122 create a moment of the arm about the pivotal axis 140 to pull the arms and jaws towards the pole in the event of slippage. It will be appreciated that although coil springs are shown connecting the arms and jaws to the yoke, any other resilient connection would be suitable. For example, an elastomer having a very strong resilient force could be used. Although it is indicated in this embodiment that serrated surfaces are not used on jaw surfaces 152 and 154 nor on yoke contact surface 132, it will be appreciated that such surfaces could in fact be serrated if so required.

Figure 12:
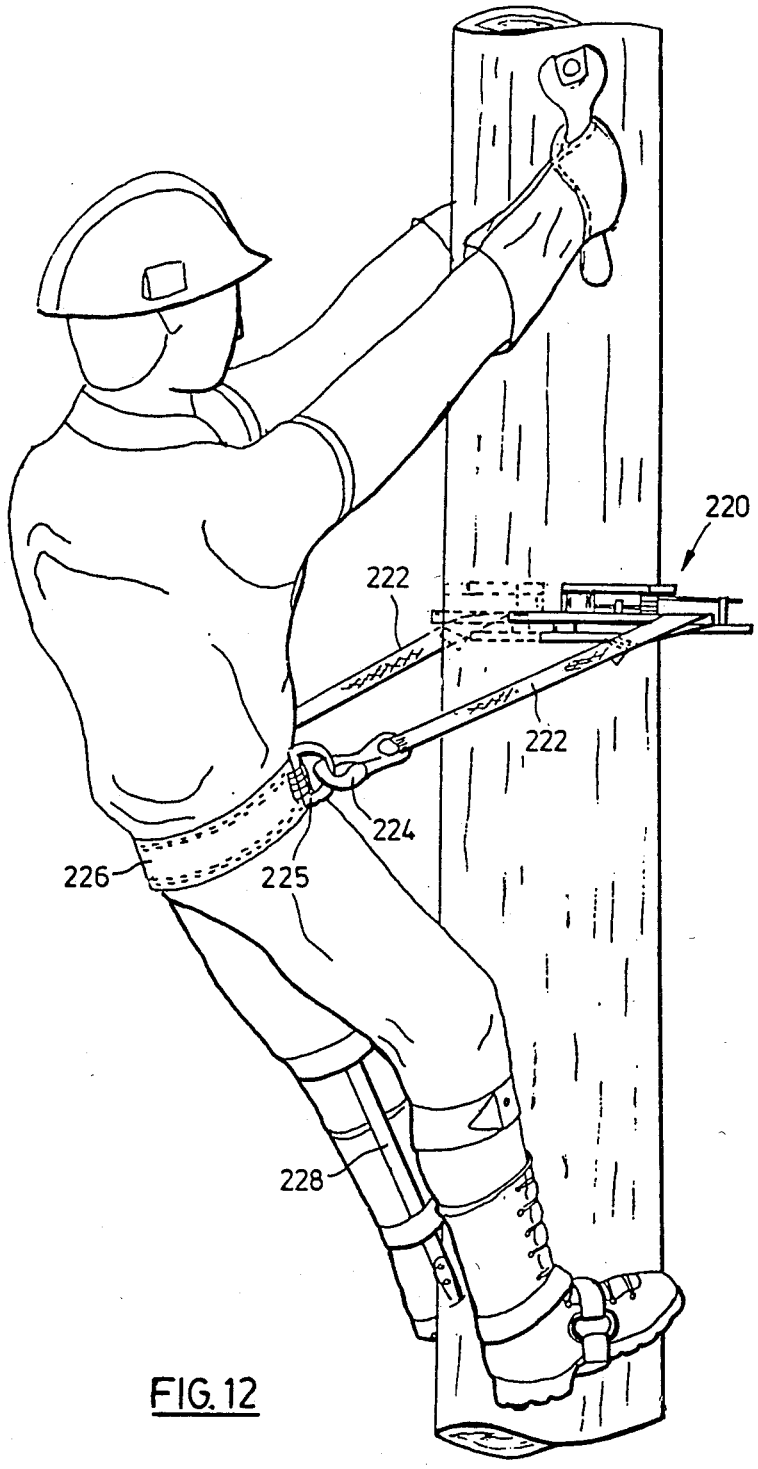
FIG. 12 is a diagrammatic view similar to FIG. 1 of a lineman using an alternative form of pole climber's fall arrest device in accordance with the invention.

Reference is now made to FIG. 12 of the drawings which shows a lineman working on a telephone pole using a fall arrest device 220 in accordance with another alternative embodiment of the invention which is secured to the pole and to which he is connected by safety straps 222. The straps 222 have respective hooks 224 at their outer ends, (one of which is shown) and which engage with D-shaped buckels 225 or "D-rings" attached to the lineman's belt 226. The fall arrest device 220 is secured around the telephone pole and, as will be later explained, the lineman is supported by a combination of pair of gaffs 228 (one of which is shown) and by the device which is biased to engage the pole. In the working position, a component of the linemans weight acts through straps 222 to produce an outwardly acting force on the fall arrest device 220 and this increases engagement of the device to the pole as will be explained.

Figure 13:
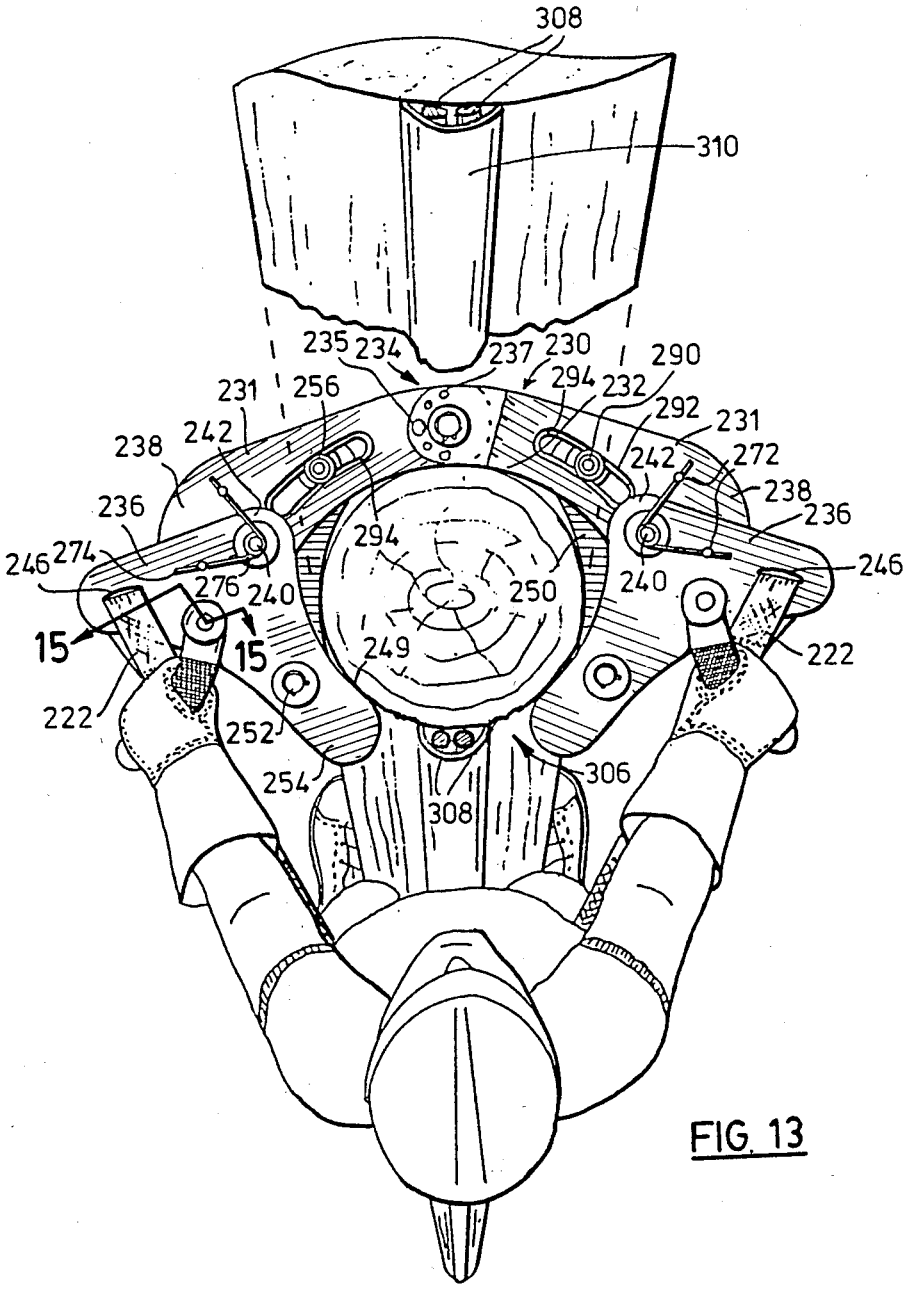
FIG. 13 is a bird's eye view of the device of FIG. 12 in use with part of the pole broken away to show the device.

To better illustrate how the fall arrest device is mounted on the pole, reference is now made to FIGS. 13 and 14 of the drawing. In FIG. 13 the pole is shown partly broken away to facilitate understanding. The fall arrest device comprises an arcuate main yoke 230 which is essentially planar and which consists of two half-yokes 231, made of an electrically insulating synthetic plastic material. The yoke 230 has an inner curved serrated surface 232 for engaging the far side of the pole from the lineman, and the yoke 230 has a hinge 234 connecting the half yokes to permit the fall arrest device to be folded for transport and storage. Also, the half-yokes 231 are adjustable relative to one another by using a locking pin 235 to engage one of respective aligned apertures 237, selected according to the diameter of the pole to be climbed.

Two planar arms 236 which for convenience of description will be described as having three apices because of its generally triangular shape, are mounted on the upper surface of each outer end 238 of the half-yokes 231 by pivotal connections 240. The arms are allochiral and for convenience of description one arm will be described although the other will be numbered for ease of comparison. The arm will also be described as having apices because of its generally triangular shape. Pivotal connections 240 connect a first apex 242 of the arm to the outer ends 238 of the yoke. A second apex 244 of the arm defines a slot 246 through which straps 222 pass to permit the fall arrest device to fasten to the linesman's belt as described above. The slot 246 is located outside the pivotal connection 240 so that when the lineman leans back a component of force also acts to force the arms to pivot about connections 240 towards the pole. The arm has an inner curved surface 248 extending between the first and second apices for engaging the pole near the front as shown in FIG. 13 and as will be seen in broken outline in FIG. 14 the curved surface has serrations 249 for engaging the pole. A smaller secondary yoke 250 is connected between the underside of the arm and the underside of the main yoke 230. The secondary yoke is connected to the arm 236 by a pivotal connection 252 at the third apex 254 of the arm and the secondary yoke is connected to each half-yoke 231 by a sliding connection 256. The pivotal connections 240, 252 and the sliding connection 256 will be explained later. As best shown in FIG. 14 the secondary yoke 250 has an inwardly facing serrated curved surface 258 for engaging the sides of the telephone pole.

One pivotal connection 240 is best illustrated in FIG. 14 and is provided by a pin 262 which passes through aligned apertures 264 and 266 in the end of the half-yoke 231 and in the apex 242 of the arm. The pin 264 has a circular groove 265 at its upper end and is of such a length that when it is passed through apertures 264, 266, it receives a washer 268 and then a spring clip 270 which engages with the groove. Inserted into the top surface of the outer end 238 of the half-yoke 231 and the arm in the vicinity of the first apex 242 are pins 272 which have apertures 273 for receiving the ends 274 of a torsion spring 276.

As best seen in the assembled portion of FIG. 14 and FIG. 13 the torsion spring 276 urges the arms 236 and secondary yokes towards each other to engage the sides of the pole as will be explained. Pivotal connection 252 is provided by pin 278 which passes through apertures 282 in the secondary yoke 250 and 280 in the second apex 254 of the arm 236 respectively. Pin 278 is shorter than the pin 262 but when assembled receives a washer 284 and spring clip 286 to fasten the arm 236 to the secondary yoke 250 in the same way as with pivotal connection 240. The secondary yoke 250 is spaced from the arm 236 by an annular spacer 288 so that the secondary yoke 250, the main yoke 230, and the arm 236 all lie in parallel planes as seen in FIG. 12.

Still referring to FIG. 14 the sliding connection 256 at the end 251 of secondary yoke 250 is a pin 290 sliding in elongate arcuate slots 292 in the main yoke 230 between the hinge 234 and each end 238 of the half-yoke 231. The elongate slot 292 has a step 294 in its wall above the lower surface of the yoke to define a narrower slot opening to the yoke lower surface. The pin 290 causes a circular bush 296 and washer 297 to be held by a spring clip 298 in the same way as with the pins 262 and 278 such that the bush 296 is supported by the step 294 to permit relative sliding movement between the secondary yokes 250 and the main yoke 230. The length and location of the slot partially dictates the pole diameters which the device can accommodate with the secondary yokes 250 engaging the pole. The location of the slots is determined by an arc on the radius of the centre point of the largest pole diameter to receive the fall arrest device.

When the device is assembled as shown in assembled portion FIG. 14 and FIG. 12, it is relatively thin and the arms, the secondary yokes and the main yoke are all in parallel planes, which facilitate operation of the device as will be later described. Each arm has a handle, 300, connected thereto to facilitate operation of the device by the lineman. Each handle is pivotally mounted to the arm by pivotal connection 302 to permit the handles to be folded up during transit or storage.

Figure 15:
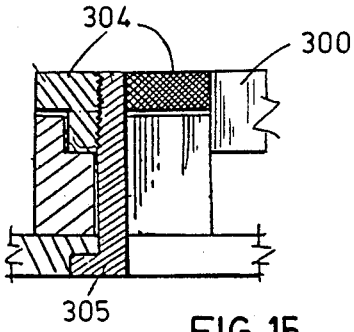
FIG. 15 is a view taken in the direction of "A" in FIG. 13, and drawn to a larger scale with part of the handle sectioned along 15—15 to better illustrate the handle mounting.

As best seen in FIG. 15 this is achieved by using a thumbwheel 304 which is fastened by screw threads onto a threaded bolt 305 which in turn is attached to arm 236. By adjusting the thumbwheel the handles can be set in a fixed position or slackened to permit them to be folded.

The device when assembled and positioned on the pole, as shown in FIG. 13, appears generally C-shaped in plan. Because the third apices of the arms do not meet they define an opening 306 which provides clearance for the cables but the fall arrest device must be adjusted to pass over the telephone pole. This clearance is convenient because it means that the fall arrest device does not interfere with cables 308 or the cable safety sheath 310 for the cables which runs between the base and top of the pole.

The operation of the fall arrest device will now be explained with reference to FIG. 13 and 16 of the drawings. In FIG. 16 one half of the fall arrest device is shown mounted (in solid lines) on a pole at a large diameter 312 and ghost outline at a small diameter 314.

Because, the lineman removes pin 235 from hinge 234 and adjusts each half-yoke 231 until opening 306 is large enough that the device can be mounted on the base 312 of the pole. The pin 235 is then inserted in an appropriate aperture 237 to lock the half-yokes relative to each other. The lineman then locates the device around the base of the pole. By gripping the handles 300, and pulling the arms 236 apart such that the arms pivot relative to the yoke against the torsion spring force produced as the pins 272 move towards each other. When the opening 306 is sufficiently large the lineman will then pull the fall arrest device towards himself and let the torsion force push the arms towards each other such that the surfaces 232, 249 and 258 of the yoke 230, arms 236 and secondary yokes 250 engage the pole at diameter 312. The lineman will then connect the device to the D-rings on his belt as previously described.

To climb the pole the lineman firstly relieves his weight on the device by using his gaffs to support his weight and then he grips the handles 300 and pulls the arms 236 apart sufficiently to separate arms 236 and yokes 250 from contacting the pole and then lifts the device to a higher position and releases the arms. The spring forces urge the arms and the secondary yokes back into contact with the pole and the lineman then using the device as a support climbs the pole using his gaffs 228.

The lineman continues to climb in this way until he reaches his desired working position i.e. at a level where pole diameter. 314 is present. At this level the torsion spring has urged the arms 236 and secondary yokes 250 into contact as shown in ghosted outline in FIG. 16 and the sliding connections 256 has moved along the elongate slot 292 toward hinge 234 and the surface contact area of the device is reduced compared to that at diameter 312 level. In this position the serrated surfaces engage the surface of the pole and the lineman leans back as shown in FIG. 12 to be supported by the straps and gaffs. In the event that his feet should slip because the gaffs are not properly engaged, each of the straps 222, are pulled down loading the arms 236 and pulling them inwardly to tightly grip the pole surface. Because of the torsion force and weight of the lineman, the device grips the pole so tightly that the device and hence the lineman does not slip down the pole. The sliding connection 256 permits the arms and the yokes to move in such a manner that they present a maximum surface contact area to engage the surface of the pole throughout its height. This means that if slippage by the lineman should occur at any level, the fall arrest device will be effective.

Various modifications may be made to the embodiment described herein without departing from the scope of the invention in which like numerals denote like parts but with the suffix "a" added. For example, although a hinge 234 connects two half yokes the connection may be replaced by an integral portion such that there is a single main yoke 230 designed for a single pole size at the base. Also, the half yokes can be connected so that the device folds about a horizontal axis in such an arrangement. A stop would be located on the surface opposite to the direction of folding, and a locking pin would be required to secure the yoke in its in-use position. The eyelets 246 need not be in the same plane as the arm 236. As also shown in FIG. 17 the arm portion containing the eyelet **246*a* is bent over substantially perpendicular to the plane of the arm to facilitate compact storage of the fall arrest device. Also, the handles 300 need not be pivotally connected to the arms. As shown in FIG. 17, the handles 300*a* could be made integral with the arms, for example by welding or other suitable method. The torsion spring is one means of resiliently biasing the arms so that they tend to close around the pole with the secondary yokes 250. Any other suitable resiliently biased means which biases the arms and the secondary yokes into contact with the pole surface would be suitable such as a leaf spring or resilient material mounted between the main yoke and the secondary yoke. Also all the contact surfaces of the pole need not be serrated, and it has been found that if the half-yoke 231, the arm 236 and the secondary yokes 250** are not serrated sufficient friction is still provided between the contact surfaces of the device and the pole to arrest the fall.

Although in the described embodiment, materials of the fall arrest device are preferably plastic, this is not essential; the components could be made out by forging or stamping, and they can be suitably treated with other electrically insulating coatings, such as nylon, PTFE etc. Also the fall arrest devices could be made of wood or plastic.

It will also be appreciated that the fall arrest device could be used on trees and on wooden, concrete and metal poles of non-circular cross-section, such as oval. Also, in the case of the alternative embodiment the position of the slots may be varied slightly to accommodate poles of different standard base diameters for most effective operation.

Other modifications may be made to the description and drawings disclosed which are exemplary without departing from the scope of the invention which is defined by the appended claims.

I claim:

1. A fall arrest device for a pole climber comprising; a main yoke member for engaging a pole and lying in a plane, two arms pivotally connected to respective opposite ends of the yoke member for further engaging said pole, each arm being rotatable relative to the yoke member about an axis generally perpendicular to the plane of the yoke member, each arm having resiliently biased means associated therewith for resilently biasing its respective arm about its pivotal axis toward the other arm, the yoke member and the arms each having a pole-engaging means for engaging the pole, each arm having handle means which can be gripped by the pole climber to rotate the arms about their pivotal axis, and attachment means located on each arm and adapted to be coupled by lanyard means to safety belt connectors, each attachment means being spaced from its respective pivotal connection, whereby, in use, said attachment means, when coupled via said lanyard means to said safety belt connectors, constitutes means effective for providing, in the event of slippage of the pole climber, a force for moving each arm towards the other arm to increase the engagement between the pole-engaging means of each arm and the pole.

2. A fall arrest device as claimed in claim 1 whereby, pole-engaging means of each arm consists of sharp projection means for biting into the pole surface.

3. A fall arrest device as claimed in claim 1 wherein said pole engaging means of said arms are constructed by jaw means pivotably mounted to each arm, each jaw means having at least one pole-contacting surface for engaging the pole, resilient biasing means connected between said arm and the yoke for urging said arms and said jaws towards each other.

4. A fall arrest device as claimed in claim 2 wherein each jaw has two pole contacting surfaces, said pole-contacting surfaces being located at different distances from the pivotable axis of the jaw, and said different pole contacting surfaces constituting means effective to permit said fall arrest device to be mounted on a wide range of pole diameters.

5. A fall arrest device as claimed in claim 3 wherein said resiliently biased means are coil springs connected between the pivotal axis of the jaws and the yoke at the pivotal axis of the arms or inboard of the pivotal axis of the arms.

6. A fall arrest device as claimed in claim 1 wherein said resiliently biased means are coil springs connected between the yoke member and each arm, the spring being attached at its respective arm to urge the arm about its pivotal connection towards the other arm.

7. A fall arrest device as claimed in claim 1 wherein said arms include handle means which the lineman grasps and pulls the arms apart against the biasing force of the resiliently biasing means.

8. A fall arrest device as claimed in claim 7 wherein, portions of the arm defining an aperture in each arm through which said lanyard means passes to couple said fall arrest device to said safety belt connector, said portions also acting as said handles.

9. A fall arrest device as claimed in claim 1 wherein a secondary yoke is connected between each arm and the main yoke member, each secondary yoke having a pivotal connection to the arm and a sliding connection to the yoke, and each secondary yoke having a pole engaging surface, the main yoke member, the arms and the secondary yokes being planar and lying in parallel planes, said parallel planes being perpendicular to the pivotal axis of the arm and the pivotal axis of the main yoke and the secondary yoke whereby, in use, as the fall arrest device is moved along a pole, sliding and pivotal connections of said secondary yoke permit the secondary yoke pole-contacting surfaces and the pole-contacting surfaces of each arm to contact the pole at different diameters.

10. A fall arrest device as claimed in claim 1 wherein the main yoke comprises two half-yokes joined by an adjustable hinge means, the adjustable hinge means permitting rotary movement of the half-yoke about an axis generally perpendicular to the plane of the yoke, the adjusting hinge means also having locking means for locking the half-yokes in one of a plurality of positions relative to each other to accommodate poles of different base diameters.

11. A fall arrest device as claimed in claim 1 or wherein each arm is resilently biased by a torsion spring mounted about the pivotal axis of said arm.

12. A fall arrest device as claimed in claim 9 or wherein each arm is resilently biased by a torsion spring mounted about the pivotal axis of said arm.

13. A fall arrest device as claimed in claim 1 wherein the main yoke member, the arms, secondary yokes and handles are all made of electrically insulating material or are coated with an electrically insulating material.

14. A fall arrest device for a pole climber comprising a main yoke member for engaging a pole, said yoke member being generally V-shaped and lying in a plane, an arm pivotally connected to each end of the main yoke member, each arm being rotatable relative to the main yoke member about an axis generally perpendicular to the plane of the yoke member, coil spring means connected between the yoke member and each arm, said coil spring means urging the respective arms to which it is attached towards the other arms, arms including sharp projection means for biting into a pole, and the main yoke member having a pole engaging surface for engaging the opposite side of the pole from the sharp projections, each arm having handle means which can be gripped by the pole climber to rotate the arm about its pivotal axis attachment, means located in each arm and adapted to be coupled by lanyard means to safety belt connectors, said attachment means being formed by portions of the arm defining an aperture to receive said lanyard means, each attachment means being spaced in its respective arm from the respective pivotal axis of the arm whereby, in-use, said attachment means, when coupled via said lanyard means to said safety belt connectors, constitutes means effective for providing, in the event of a slippage of the pole climber, a force for moving each arm towards the other arm to increase the engagement between the sharp projections and the pole.

15. A fall arrest device as claimed in claim 14 wherein stop means are coupled between said yoke and each arm to limit the movement of each arm, the arms and the main yoke forming a C-shape in plan and defining an opening between the arms by which the fall arrest device can be fitted around the pole, and the main yoke member and arms being made of electrically insulating material or coated with electrically insulating material.

16. A fall arrest device for a pole climber comprising a main yoke member for engaging a pole, said yoke member being generally V-shaped and lying in a plane, two arms pivotably connected to respective opposite ends of the yoke member, each arm being pivotable relative to the yoke member about an axis generally perpendicular to the plane of the yoke member, each arm being resiliently biased by spring means towards the other arm, each arm having jaws connected thereto said jaw means being pivotable relative to its respective arm about an axis generally perpendicular to the plane of the yoke member, the yoke member having a pole-engaging surface and each of the jaws having two pole-engaging surfaces for engaging the pole, said pole-contacting surfaces being located at different distances from the pivotable axis of the jaw, and said different pole contacting surfaces constituting means effective to permit said fall arrest device to be mounted on a wide range of pole diameters and resilient biasing means in the form of coil springs connected between each of the pivotal axis of the jaws and the yoke at the pivotal axis of the arms or inboard of the pivotal axis of the arms for urging said arms and jaws into engagement with the pole, each arm having handle means for grasping by the pole climber to rotate the arm about its pivotal axis, and attachment means located on the arm outside respective pivotal connection between the arm and the yoke by which the fall arrest device can be coupled to safety belt connectors.

17. A fall arrest device for a pole climber comprising a pair of planar arcuate half-yokes for engaging pole, said half-yokes being joined by adjustable hinge means for permitting rotary movement of the half-yokes about an axis generally perpendicular to the plane of the half-yokes, the adjustable hinge means having locking means for locking the half-yoke in one of a plurality of positions relative to each other to accommodate poles of different base diameters, the outer end of each half-yoke being pivotally connected by a first pivotable connection to a generally planar arm parallel with the half-yoke plane each arm being rotatable relative to its respective half-yoke about a pivotal axis perpendicular to the plane of the arm, an arcuate planar secondary yoke connected between each arm and each half-yoke and lying in a plane parallel thereto, the connection between the secondary yoke and the arm being a second pivotal connection and the connection being the secondary yoke and the main yoke being sliding, each arm being resilently biased about its pivotal axis towards the other arm and said secondary yokes also being biased towards each other, the arms, yokes and secondary yokes forming a C-shape in plan and defining an opening between the arms by which the fall arrest device can be fitted around the pole, both half-yokes, both arms and both secondary yokes having a respective pole engaging surface for engaging part of the surface of the pole, each arm having a pivotable handle for gripping by the pole climber to move the arms about their pivotal axis and to cause the secondary yokes to move in their planes, and each arm having attachment means located on the arms outside the first pivotal connection by which the fall arrest device can be coupled to safety belt connections whereby, in use, said fall arrest device is located on the pole such that the arms and secondary yokes are resilently biased into contact with the pole surface and the pole is contacted by the half-yoke pole contacting surfaces, said fall arrest device being movable up or down the pole by said climber gripping said handles and moving them against the resilently biased force away from the pole and then moving the device up or down the pole.

18. A fall arrest device as claimed in claim 1, wherein the arms and the main yoke form a C-shape in plan and defining an opening between the arms by which the fall arrest device can be fitted around the circumference of a pole.

19. A fall arrest device as claimed in claim 4, wherein the arms, yoke and secondary yokes are form a C-shape in plan and defining an opening between the arms by which the fall arrest device can be fitted around the circumference of a pole.

20. A fall arrest device as claimed in claim 7, wherein the main yoke member, the arms, secondary yokes and handles are all made of an electrically insulating material.

* * * * *